United States Patent [19]

Manheimer et al.

[11] Patent Number: 4,559,475

[45] Date of Patent: Dec. 17, 1985

[54] QUASI-OPTICAL HARMONIC GYROTRON AND GYROKLYSTRON

[75] Inventors: Wallace Manheimer, Silver Spring, Md.; Baruch Levush, Haifa, Israel

[73] Assignee: The United States of America as represented by the Secretary of the Navy, Washington, D.C.

[21] Appl. No.: 630,049

[22] Filed: Jul. 12, 1984

[51] Int. Cl.[4] ..... H01J 25/00

[52] U.S. Cl. ..... 315/4; 315/3; 315/5; 315/5.24; 372/2; 372/99

[58] Field of Search ..... 315/3, 4, 5, 5.41, 5.44, 315/5.24, 5.26; 372/2, 97, 99; 330/4, 4.1

[56] References Cited

U.S. PATENT DOCUMENTS

| | | | |
|---|---|---|---|
| 3,253,226 | 5/1966 | Herriott et al. | 372/99 |
| 3,479,620 | 11/1969 | Rigrod | 372/99 |
| 4,197,483 | 4/1980 | Karayianis et al. | 315/4 |
| 4,282,458 | 8/1981 | Barnett | 315/4 |
| 4,298,824 | 11/1981 | Walsh | 315/4 |
| 4,370,621 | 1/1983 | Sprangle et al. | 315/5 |
| 4,389,593 | 6/1983 | DeSantis et al. | 315/4 |
| 4,398,121 | 8/1983 | Chodorow et al. | 315/4 |
| 4,491,765 | 1/1985 | Manheimer et al. | 315/5 |
| 4,517,677 | 5/1985 | Altmann | 372/99 |
| 4,519,708 | 5/1985 | Perlmutter et al. | 372/99 |

OTHER PUBLICATIONS

Bondeson et al., "Multimode Theory and Simulation of Quasioptical Gyrotrons and Gyroklystrons" Int. J. Electronics, 1982, vol. 53, No. 6, pp. 547–553.

Levush et al., "Theory of Quasioptical Gyrotrons and Gyroklystrons Operating at Higher Harmonics of the Cyclotron Frequency" Int. J. Electronics, 1983, vol. 54, No. 6, pp. 749–775.

Ott et al., "Theory of Microwave Emission by Velocity-Space Instabilities of an Intense Relativistic Electron Beam" IEEE Transactions on Plasma Science, vol. PS-3, No. 1, Mar. 1975.

Bondeson et al., "Multimode Analysis of Quasi-Optical Gyrotrons and Gyroklystrons" Infrared and Millimeter Waves, vol. 9, Chapter 7, pp. 309–340, 1983.

Levush et al., "Cavity Design for Quasi-Optical Gyrotron and Gyroklystron Operation at Harmonics of the Cyclotron Frequency" Intl J. Infrared and Millimeter Waves, Nov. 1983, pp. 877–889.

Levush et al., "Generation of High Frequency Radiation by Quasi-Optical Gyrotron at Harmonics of the Cyclotron Frequency", Sep. 1983, Posted at Conference on Bulletin Board, Beams 83 International Conference on Intense Particle Beams.

*Primary Examiner*—Saxfield Chatmon

*Attorney, Agent, or Firm*—Robert F. Beers; William T. Ellis

[57] ABSTRACT

A method and apparatus for suppressing lower order cyclotron harmonics in order to permit resonance within a quasi-optical gyrotron/gyroklystron configuration of a desired higher order harmonic. In the gyrotron/gyroklystron configuration at least one open resonator defined by at least two mirrors is positioned downstream from an electron beam source for receiving therethrough the beam of electrons and for exchanging energy therewith. This method includes the steps of choosing a mirror radius size $\rho$ for the mirrors forming the at least one open resonator which is large enough relative to the spot size of a desired radiation cyclotron harmonic $\omega_n$ so that the harmonic $\omega_n$ oscillates within the at least one resonator, but small enough so that the spot size for the next lower cyclotron harmonic $\omega_m$ is larger than the mirror so that the harmonic $\omega_m$ does not oscillate due to diffraction losses. This method further includes the step of generating an electron beam via the electron beam source with a beam current which is greater than or equal to the starting current $I_n$ for the desired nth cyclotron harmonic, but less than the starting current $I_m$ for the mth cyclotron harmonic. The method also includes the step of extracting radiation energy at the nth cyclotron harmonic from the at least one open resonator. The desired mirror radius size $\rho$ for a given cyclotron harmonic frequency $\omega_n$, for a desired diffraction loss $Y_n$ for that harmonic n, a given half length separation $L_y$ between the mirrors, and a given radius of curvature $R_M$, can be determined by the equation $$Y_n = \exp - \left[ \frac{\rho}{r_{on}} \right]^2, \quad (1)$$

wherein $r_{on}$ is the spot size at the mirror for radiation at the nth cyclotron harmonic.

8 Claims, 2 Drawing Figures

QUASI-OPTICAL HARMONIC GYROTRON AND GYROKLYSTRON

BACKGROUND OF THE INVENTION

The present invention relates to the generation of high power electromagnetic radiation in the millimeter and submillimeter wave regime, and more particularly to quasi-optical gyrotron and gyroklystron operation at harmonics of the cyclotron frequency.

The major device currently available for generating millimeter and submillimeter wavelengths is the gyrotron. The gyrotron is a new type of microwave device employing the electron cyclotron maser mechanism. It ideally consists of an ensemble of monoenergetic electrons following helical trajectories around the lines of an axial magnetic field inside a fast wave structure such as a metallic tube or waveguide. The physical mechanism responsible for the radiation in the gyrotron has its origin in a relativistic effect. Initially, the phases of the electrons in their cyclotron orbits are random, but phase bunching (relativistic azimuthal bunching) can occur because of the dependence of the electron cyclotron frequency on the relativistic electron mass ($\Omega_c = eB/\gamma mc$). Those electrons that lose energy to the wave become lighter, rotate faster, and hence, accumulate phase lead, while those electrons that gain energy from the wave become heavier, rotate slower, and accumulate phase lag. This rotating electron interaction with the wave results in phase bunching such that the electrons radiate coherently and amplify the wave. Energy transfer from the electrons to the wave is optimized when $\omega - k_z v_{zo} - n\Omega_c \geqq 0$, where $\omega$, $k_z$, $v_{zo}$, n, and $\Omega_c$, are, respectively, the wave frequency, axial wave number, axial electron velocity, cyclotron harmonic number, and electron cyclotron frequency.

In essence, there is an intrinsic preference for relativistic azimuthal phase bunching in the presence of an electromagnetic wave. This bunching yields a different configuration of electrons in a lower energy state. If the incident wave has a frequency slightly larger than $\Omega_c$ or its harmonics, then stimulated emission will occur. Since this bunching mechanism occurs in phase with the electromagnetic wave, the stimulated radiation emission from the bunching is also emitted in phase with the wave, leading to wave amplification.

The gyrotron stimulated radiation emission occurs near the frequency $\omega = \Omega_c + k_z v_{zo}$. Since $\omega_c = e\beta/\gamma mc$, the radiation wavelength is determined primarily by the strength of the applied magnetic field and is not restricted necessarily by the dimensions of a resonant structure. Thus, unlike most other microwave tubes, the internal dimensions of the device may be large compared to the wavelength, and high power handling capability becomes compatible with operation at millimeter and submillimeter wavelengths. This high power operation of the gyrotron has been demonstrated.

It is generally desired to scale the cavity gyrotron in accordance with the wavelength such that two or three wavelengths can be set up across the cavity. However, as the wavelength decreases, and the cavity shrinks down, the power density increases and the wall loses become important. Thus, although the operating power level of the gyrotron is high, it is limited by the relatively small interaction volume as the wavelength decreases (the frequency increases). In order to circumvent this limitation, a quasi-optical single or double cavity configuration is utilized. An example of such a quasi-optical design is disclosed in U.S. patent application Ser. No. 414,129, filed on Sept. 2, 1982, now U.S. Pat. No. 4,491,765 by the Inventors, Manheimer, Bondeson, and Ott (Navy Case No. 66,517).

In order to achieve still higher frequency operation and/or operate a reduced magnetic field in the device, it is desirable to operate at harmonics of the cyclotron frequency. A variety of studies (see the citations in the paper "Cavity Design for Quasi-Optical Gyrotron and Gyroklystron Operation at Harmonics of the Cyclatron Frequency" by Levush and Manheimer, International Journal of Infrared and Millimeter Waves, November 1983, pages 877–889) have demonstrated that such harmonic operation may be possible at some reduction in efficiency and/or some increase in wave electric field amplitude in the cavity. However, the difficulty with all of these studies is that they assume only a single cyclotron harmonic is present in the cavity. In actuality, if the third cyclotron harmonic is desired, some means must be utilized to suppress the fundamental and the second harmonic, which are generally stronger processes with much more energy. Without some sort of suppression, the fundamental and the second harmonic would swamp higher harmonics, thereby preventing the generation of high power coherent radiation at such higher harmonics in a controlled manner. In previous studies of harmonic operation of gyrotrons in conventional non-optical cavities, this problem was solved simply by designing the cavity shape so that the fundamental and any other undesired lower harmonics are not eigenfunctions of the cavity. Typically, the cavity is shaped so that it is resonant at only one cyclotron harmonic. (See K. R. Chu, Phys. Fluids, 21, 2354 (1978)) and Zepalof, Korablev, and Tsimring, Radiotech. Electron, 22, 86 (1977). Thus, to operate at the third harmonic, one picks a cavity shape and a mode such that the fundamental and the second harmonic are not resonant.

However, in a quasi-optical configuration, this cavity shaping is not possible because all harmonics are simultaneously resonant in such an optical cavity. In particular, all resonant modes in such an optical cavity are integrally related.

OBJECTS OF THE INVENTION

Accordingly, it is an object of the present invention to provide a quasi-optical gyrotron/gyroklystron configuration operating at a desired cyclotron harmonic wherein the fundamental and all lower order cyclotron harmonics are suppressed.

It is a further object of the present invention to efficiently generate high power higher order cyclotron harmonics in a quasi-optical gyrotron/gyroklystron configuration.

It is yet a further object of the present invention to significantly reduce the magnetic field required in a quasi-optical gyrotron/gyroklystron configuration in order to generate very high frequency cyclotron harmonics.

It is still a further object of the present invention to efficiently generate high power higher order cyclotron harmonics in a quasi-optics configuration using a large radiation volume.

Other objects, advantages, and novel features of the present invention will become apparent from the detailed description of the invention, which follows the summary.

SUMMARY OF THE INVENTION

Briefly, the present invention comprises a method and an apparatus for suppressing lower order cyclotron harmonics in order to permit resonance within a quasi-optical gyrotron/gyroklystron configuration of a desired higher order harmonic. This method and apparatus exploits the fact that at lower cyclotron harmonics, the radiation spot size in the resonant cavity is larger than at higher order harmonics so that the diffraction loses are higher for such lower order harmonics. This phenomenon is utilized in combination with the fact that each cyclotron harmonic in a given resonant cavity has a starting electron beam current which is just sufficient to permit radiation into that harmonic, in order to yield a new device design.

The present method for generating such higher order harmonics of the cyclotron frequency in a quasi-optical gyrotron/gyroklystron configuration is set in the context of a magnetic structure for producing a magnetic field parallel to an axial direction, an electron beam source for imparting momentum to the electons in the axial direction to define an electron beam travelling in the axial direction, and for imparting momentum to the electrons in the beam perpendicular to the axial direction to cause the electrons in the beam to execute gyratory motion, and at least one open resonator defined by at least two spherical mirrors positioned downstream of the electron beam source for receiving therethrough the beam of electrons and for exchanging energy with the beam of electrons. The axis of the open resonator is at an angle to the magnetic field. Generally, the angle is 90°, although other choices are possible. This method includes the steps of choosing a mirror radius size $\rho$ for the mirrors forming the at least one open resonator which is large enough relative to the spot size of a desired radiation cyclotron harmonic $\omega_n$ so that the harmonic $\omega_n$ oscillates within the at least one resonator, but small enough so that the spot size for the next lower cyclotron harmonic $\omega_m$ is larger than the mirror so that the harmonic $\omega_m$ does not oscillate due to diffraction losses. This method further includes the step of generating an electron beam via the electron beam source which is greater than or equal to the starting current $I_n$ for the desired nth cyclotron harmonic, but less than the starting current $I_m$ for the mth cyclotron harmonic, where $m<n$, and the step of extracting radiation energy at the nth cyclotron harmonic from the at least one open resonator.

The desired mirror size $\rho$ for a given cyclotron harmonic frequency $\omega_n$, for a desired diffraction loss $Y_n$ for that harmonic n, a given half length separation $L_y$ between the mirrors, and a given radius of curvature $R_M$, can be determined by the equation $$Y_n = \exp - \left[ \frac{\rho}{r_{on}} \right]^2, \tag{1}$$

where $r_{on}$ is the spot size at the mirror for radiation at the nth cyclotron harmonic.

DETAILED DESCRIPTION OF THE PREFERRED EMBODIMENT

Figure 1:
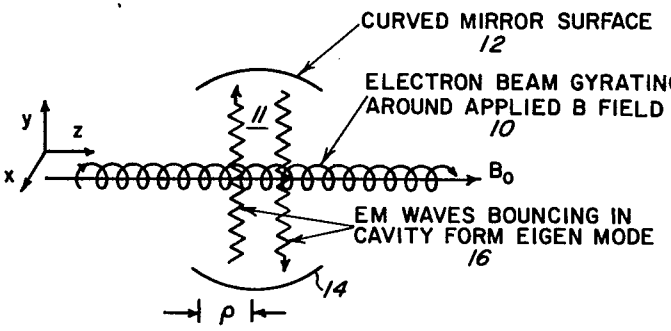
FIG. 1 is a quasi-optical gyrotron configuration with the magnetic field in the z direction and the radiation bouncing back and forth in the y direction with its electric field polarized in the x direction.

Referring now to FIG. 1, there is disclosed a quasi-optical gyrotron configuration with the magnetic field $B_o$ in the z direction. An electron beam 10 gyrates around this magnetic field $B_o$ and propagates in the z direction. A pair of opposing spherical mirror surfaces 12 and 14 define an optical cavity 11 or resonator. Electromagnetic radiation waves 16 bounce or resonate in this cavity to form radiation Eigenmodes. The radiation modes in resonance are typically initiated simply by noncoherent electron radiation noise from the electron beam. The foregoing is the basic quasi-optical gyrotron configuration. It is known that for such a configuration where the electrons in the beam are only slightly relativistic, the linearized efficiency is a rapidly decreasing function of the harmonic number so that lower harmonics normally dominate within the cavity. It is desired to suppress the fundamental and lower order cyclotron harmonics in order to permit a desired higher order cyclotron harmonic to resonate within the cavity 11. This fundamental and lower order cyclotron harmonic suppression is achieved in the present design by utilizing the fact that the radiation spot size increases as the harmonic number decreases. Accordingly, by properly sizing the mirrors 12 and 14, it is possible to significantly increase the diffraction losses at lower order cyclotron harmonics while permitting a desired higher order cyclotron harmonic to resonate within the cavity 11. This mirror sizing for the cavity is done in conjunction with the choice of a particular beam current which is greater than or equal to the starting current $I_n$ for the desired nth cyclotron harmonic but less than the starting current $I_m$ for the next lowest order cyclotron harmonic.

The radiation spot size $r_{on}$ at a given cyclotron harmonic can be calculated utilizing the following equation:

$$r_{on} = \left[ \frac{\lambda_o R_M}{n\pi} \quad \frac{1}{(R_M/L_y - 1)^{\frac{1}{2}}} \right]^{\frac{1}{2}}, \tag{2}$$

where $R_M$ is the radius of curvature for each of the mirrors 12 and 14, $L_y$ is the half length of the cavity, $\lambda_o$ is the wavelength of the cyclotron fundamental, and n is the cyclotron harmonic number.

It has been discovered that the fraction of the radiation diffracted around a given mirror at the nth harmonic $Y_n$ is given by the following equation:

$$Y_n = \exp - \left[ \frac{\rho}{r_{on}} \right]^2, \tag{3}$$

where $\rho$ is the mirror size radius for the mirrors 12 and 14 assuming circular shaped mirrors.

The technique for sizing the mirrors at the nth cyclotron harmonic is to choose a diffraction loss number $Y_n$ for that harmonic which is small enough that the nth harmonic oscillates, but lower order cyclotron harmonics do not. It has been discovered that $Y_n$ should be less than 0.05 and greater than 0.001 for proper oscillation of the desired harmonic. A typical choice for $Y_n$ for such a higher order harmonic is a 1% or a 0.01 diffraction loss. It has been discovered that the diffraction loss at other cyclotron harmonics are related to the diffraction loss $Y_n$ for the desired nth harmonic by the following equation:

$$Y_m = Y_n^{m/n} \tag{4}$$

It has been further discovered that if the next lower cyclotron harmonic has a diffraction loss $Y_m$ of 5% or greater, then that next lower order harmonic and all other lower order harmonics and the fundamental will be suppressed and will not oscillate in the optical cavity 11. For further detail on the above equations, see the paper noted previously by Levush and Manheimer in the International Journal of Infrared and Millimeter Waves, Nov. 83. It should be noted that a preferred diffraction loss $Y_m$ for the next lower harmonic is 10% to suppress oscillation in the cavity.

The present technique of lower order cylotron harmonic suppression utilizes the sizing of the cavity or resonator mirrors in combination with an appropriate choice of beam current. In order to choose the proper beam current for starting oscillations at a desired higher order harmonic with a given value of diffraction losses in the resonator cavity, while preventing oscillations at lower order cyclotron harmonics, it is required to calculate the threshold or starting beam currents for the desired harmonic and the next lower order harmonic. In this regard, Eq. (5) set out below may be calculated to determine the ratio of the starting currents at the nth harmonic $I_n$ to the mth harmonic $I_m$ $$\frac{\eta_n I_n}{\eta_m I_m} = Y_m^{(n/m-1)}, \tag{5}$$

where $\eta_n$ and $\eta_m$ are the linear small signal efficiencies for the gyrofrequency harmonics n and m, respectively, of the cavity field oscillation, and $Y_m$ is the diffraction loss for the mth harmonic, as noted previously.

The starting current for a given gyro harmonic is defined as the current where the optical cavity is just beginning to store more of the input energy from the electron beam than it gives up in radiation and other losses. This starting current definition simply reflects the basic threshold condition that for an excitation to start in a resonator, the electron beam power flowing into the optical interaction cavity is greater than or equal to the cavity energy loss. This condition is reflected in the following equation:

$$\eta P_{in} \geqq \omega \epsilon_{stored}/Q \tag{6}$$

where $P_{in} = I_e V_e$ is the total electron beam power flowing into the interaction cavity, I is the electron beam current, V is the electron beam voltage, $\epsilon_{stored}$ is the stored field energy, where $$\epsilon_{stored} = (E_o^2/16\pi)\pi r_o^2 L_y. \tag{7}$$

$r_o$ is the radiation spot size at the center of the optical cavity, and is given by $$r_o = \left[\frac{\lambda L_y}{\pi}\left(\frac{R_m}{L_y} - 1\right)^{\frac{1}{2}}\right]^{\frac{1}{2}}, \tag{8}$$

$E_o$ is the energy of the electron beam, $L_y$ is half length of the cavity, $R_M$ is the mirror radius of curvature, and $\lambda$ is the harmonic wavelength. The term Q reflects the losses in the optical cavity and, assuming that the power reflection coefficient is l-Y (a fraction Y of the power is transmitted through or diffracted around the mirror) and neglecting dissipation of energy in the mirrors, Q may be calculated as follows:

$$Q = \frac{4Ly\omega_n}{cY}, \tag{9}$$

where $\omega_n$ is the nth harmonic frequency. The term $\eta_i$ is the linear small signal efficiency for a given gyrofrequency harmonic i of a cavity field oscillation, and is calculated as follows:

$$\eta_i = \frac{\pi}{4} \cdot \frac{1}{(\gamma_o - 1)\gamma_o}\left[\frac{E_o}{B}\right]^2 \epsilon_o^2 \left[\frac{\Omega_o}{\omega_i}\right]^2 J_i'(\zeta_o)\exp\left[-\left(\epsilon_o \frac{\Delta\omega}{\omega_i}\right)^2 2\right] \cdot \left[\frac{\beta_{\perp o}^2 \Delta\omega}{2\omega_i}\epsilon_o^2 J_i'(\zeta_o) + \zeta_o J_i(\zeta_o)\left[1 - \frac{i^2}{\zeta_o^2}\right]\right],$$

where $\gamma_o$=electron energy divided by its rest energy $E_o$=electric field at the center of the optical cavity B=magnetic field in the cavity $\omega_i$=harmonic frequency whose efficiency is being calculated $\beta_{\perp o} = p_{\perp o}/m_e\gamma_o \cdot c$ $p_{zo}$=momentum of the electron beam in the z direction $\epsilon_o = (r_o\omega_i/c)/\beta_{zo}$ $r_o$=spot size for the cyclotron harmonic whose efficiency is being calculated at the cavity center $\Omega_o = e\,B_o/mc$ $J_i$=Bessel function of order i $\beta_{zo} = p_{zo}/m_e\gamma_o c$ $J'_i$=derivative of the Bessel function of order n $\zeta = k\rho\perp/m\Omega_o$ $\rho\perp$=transverse momentum of the electrons in the beam $k = \omega_i/c$ i=cyclotron harmonic number for the cyclotron harmonic whose efficiency is being calculated $\Delta\omega$=frequency displacement of the radiation resonating in the resonator from the cyclotron harmonic $\omega_i$ which maximizes $\eta_i$ for that harmonic.

Setting the electron beam power $\rho = \eta IV$ into the optical cavity at a harmonic n equal to the power lost by the optical cavity, $$\frac{\omega_n \epsilon}{Qn}$$

stored, for the threshold current condition, then $$P = \eta IV = \frac{\omega_n}{Q_n}\epsilon_{stored} = \frac{\omega_n(E_o^2/16\pi)\pi r_o^2 Ly}{4Ly\omega_n/cY}, \tag{11}$$

or for a given harmonic n, $$I_n = \frac{(E_o^2/16)r_o^2}{\eta_o V4/Y_n c} = \frac{E_o^2 r_o^2}{64} \cdot \frac{Y_n c}{\eta_n V}. \quad (12)$$

Note that since $\eta_n$ depends on $E_o^2$, $E_o^2$ drops out in the equation for $I_n$. Note that $\eta_n$ depends on $\Delta\omega$, the frequency displacement from the harmonic. The starting current at a particular harmonic is defined as the starting current for that $\Delta\omega$ which minimizes $I_n$. In order for the harmonic n to oscillate in the optical cavity, the current I must be greater than or equal to the starting current $I_n$. However, in order to prevent the next lower harmonic m from oscillating, the current I must be less than the starting current $I_m$ for the mth harmonic. Thus, by calculating the starting current $I_m$ via equation (12) for the mth harmonic, a range of operating currents, $I_n \leqq I < I_m$, may be calculated for permitting the nth harmonic to oscillate while preventing the mth harmonic from oscillating.

Note that given a starting current $I_n$, other starting currents $I_m$ may also be conveniently calculated using the equation $$\frac{\eta_n I_n}{\eta_m I_m} = Y_m^{(n/m-1)}. \quad (13)$$

For further discussion on the calculation of the starting currents for selected harmonics, see the previously noted paper by Levish and Manheimer in the International Journal of Infrared and Millimeter Waves, Nov. 83.

There is wide latitude in the parameters that can be used in the device of FIG. 1. It is noted that harmonic radiation interaction with the electron beam is most efficient at high electric fields. However, the radiation electric field at the mirrors 12 is limited by a breakdown voltage limit. This breakdown limit is the voltage at which the mirrors ionize and emit electrons (usually about 200 kV/cm). If the value of the radiation field of the spot (volts/cm) at the center of the mirror exceeds this voltage breakdown limit, then the cavity $R_M$ and $L_y$ parameters may be chosen to exploit the focusing effect. This is accomplished by moving the mirrors further away thereby causing the radiation to fan out and reduce the volts/cm intensity at the mirror. The field $E_M$ at the mirrors 12 may be represented in terms of the electric field at the center of the optical cavity by $$E_M = E_o[1 - L_y/R_M]^{\frac{1}{2}},$$

where $E_o$ is the electric field at the center of the optical cavity; $L_y$ is half separation of the mirrors, and $R_M$ is the mirror radius of curvature. Thus, it can be seen that the field $E_M$ at the mirror can be substantially smaller than the field $E_o$ at the center of the optical cavity.

With respect to the half separation $L_y$ of the mirrors 12, typically it takes values in the range $$10\lambda \leqq L_y \leqq 1000\lambda,$$

where $\lambda$ is the radiation wavelength. The only constraints are that $L_y$ not be so small that the mirror electric field breakdown limit is exceeded, or so large that the resonating radiation is no longer single mode.

The parameter $R_M$, the mirror radius of curvature, is typically determined empirically. The only constraint is that $R_M > L_y$.

The electron beam energy $\gamma_o$ is typically set within a range of 60–250 KV, although other energy ranges are possible. It is generally desired to make the beam energy $\gamma_o$ as low as possible so that a compact device can be realized that can be used in confined spaces, i.e., an aircraft. The momentum ratio $\alpha$ for the electron beam may be represented as follows:

$$\alpha_o = P_\perp / P_=,$$

where $P_\perp$ is the perpendicular momentum of the electrons in the beam, and $P_=$ is the electron momentum in the z direction. Typically, for second and third harmonic operation, $\alpha$ will be about 1.5; for eighth harmonic operation, $\alpha$ will be about 3–5. $P_\perp$ and $P_z$ are generally chosen by empirically determining where the efficiency peaks in the device operation.

The magnetic field B for the device is generally set when the cyclotron frequency harmonic $\omega_n$ is chosen in accordance with the following equation:

$$\omega_n = ne\, B/\gamma_o mc.$$

where n is the harmonic number, e is the electron charge, $\gamma_o$ is the electron beam energy, m is the electron mass, and c is the speed of light.

Figure 2:
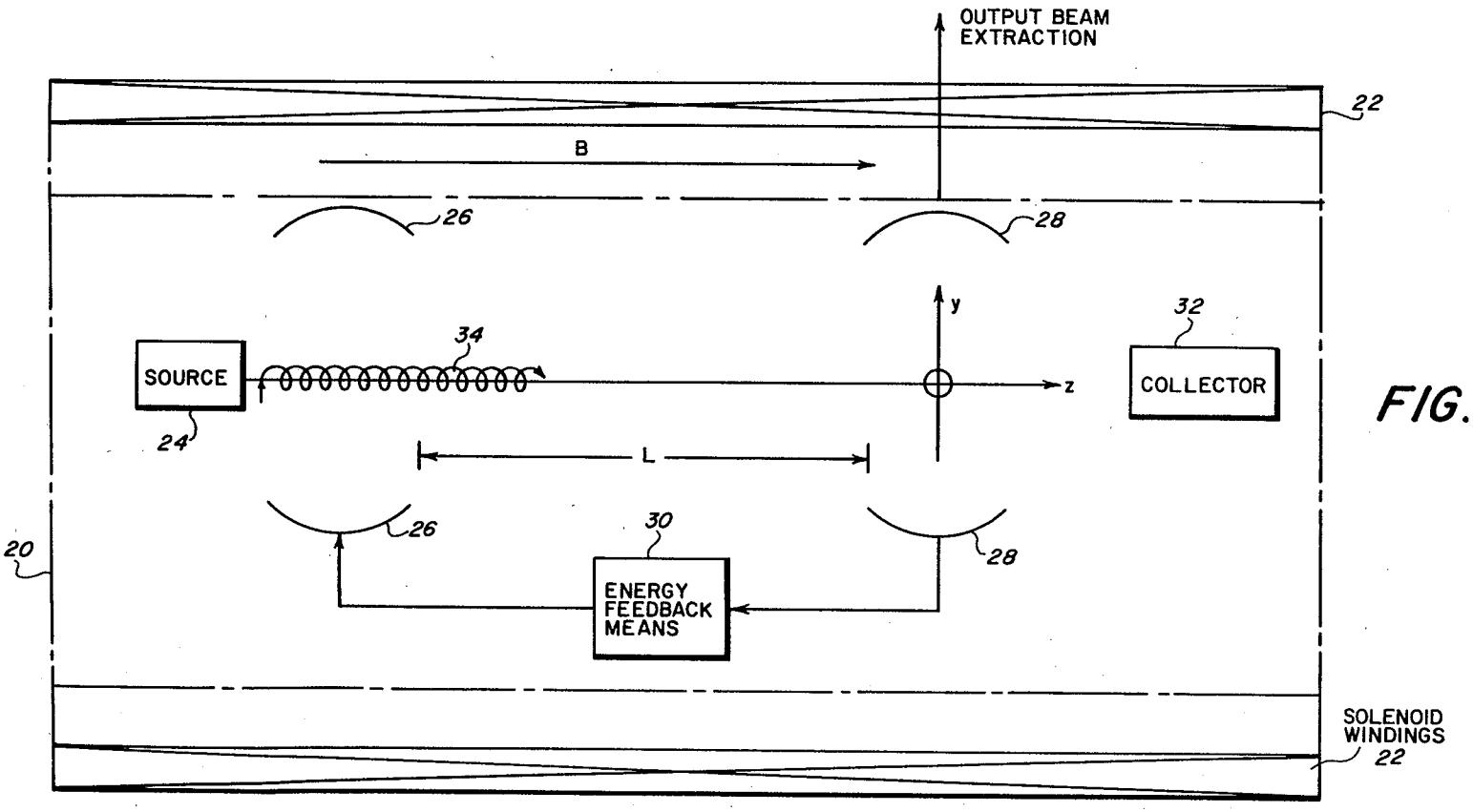
FIG. 2 is one embodiment of a quasi-optical gyrotron/gyroklystron configuration utilizing two separate open resonators.

A second embodiment for implementing the present invention is shown in FIG. 2. This embodiment utilizes a two-optical cavity gyroklyston configuration.

Referring to the Figure, the quasioptical gyroklystron employs an evacuated tube 20 surrounded by means such as solenoidal windings 22 for producing an axial magnetic field B whose direction is indicated by arrow z; a relativistic electron beam source 24 axially disposed within the tube; a first open spherical mirror resonator 26 positioned downstream of the electron beam source 24; a second open spherical mirror resonator 28 positioned downstream of the first resonator 26; energy feedback means 30 coupled between the second and first resonators; and a collector electrode 32 positioned downstream of the second resonator.

While the relativisitic electron beam source 24 may take a variety of forms, conveniently it may take the form of a magnetron injection gun as described in the article "An Investigation of a Magnetron Injection Gun Suitable for Use in Cyclotron Resonance Masers" by J. L. Seftor etal. in *IEEE Transactions on Electron Devices,* Vol ED-26, No. 10, Oct. 1979, pp. 1609–1616, whose disclosure is herewith incorporated by reference. Suitable mirror resonators are described in Section 4.3 of the text *Introduction to Optical Electronics,* 2nd Ed., by Amnon Yariv and references cited therein, and the disclosures thereof are also incorporated by reference. Finally, while the energy feedback means 30 may take a variety of forms, conveniently it may take the form of a waveguide with a squeeze-section phase-shifter, such as described in Section 9.2.1 of the text *Plasma Diagnostics with Microwaves* by M. A. Heald and C. B. Wharton, whose disclosure is herewith incorporated by reference.

In operation of the quasioptical gyroklystron, the relativistic electron beam source 34 imparts a momentum $P_z$ to each of the electrons in the axial direction indicated by arrow z to define a low energy (mildly relativistic) electron beam 34 traveling in that direction, and imparts a momentum $P_\perp$ to the electrons in the beam perpendicular to the axial direction (e.g., in the direction indicated by the arrow y) to cause the electrons to execute a gyrating motion about the direction of the magnetic field B. The first and second open spherical mirror resonators 26 and 28 have a common single wave mode frequency $\omega_n$ which is slightly more than an integral multiple of the relativistic cyclotron frequency $\Omega_o/\gamma_o$ of the electrons in the beam (i.e., their rotation frequency), where $\Omega_o$ is the nonrelativistic cyclotron frequency and $\gamma_o$ is the relativistic mass factor of the electrons at the entrance to the first resonator 26. The first open spherical mirror resonator 26 receives the electron beam 34 therethrough and exchanges energy with the beam to vary the speed of gyration of each electron in the beam according to the relative phase between its gyratron and the wave mode fields in the resonator 26. The electron beam 32 passes on to the second open spherical mirror resonator 28 which likewise receives the beam of electrons therethrough. The separation of the second resonator 28 from the first resonator 26 is such that rapidly gyrating electrons in the beam 32 overtake slowly gyrating electrons at the entrance to the second resonator 28 with the right phase angle to lose power efficiently to wave mode fields in the second resonator. In essence, the optical resonator 26 contains sufficient low power radiation to initiate bunching of the electrons in the beam. In the drift space between the resonators 26 and 28, the electrons ballistically bunch in azimuthal angle. On entering the second optical resonator 28 strong bunching occurs, and the bunched beam radiates its energy efficiently. This excited radiation is trapped in the quasi-optical resonator 28, whose parameters have been chosen so that the specified harmonic $\omega_n$ resonates.

Note that the beam 34 of electrons exits the second resonator 28 and is collected by the collector electrode 32. By way of example, this collector 32 may be a depressed collector, i.e., a potential well for taking energy from the electron beam and returning it to the electric circuit as the beam slows. The amplitude and phase of the radiation in resonator 26 is controlled by the feedback means 30. The feedback means 30 feeds back a small amount of energy to the first resonator 26 from the mode in the second resonator 28 with a phase lag of approximately $\pi/2$ to generate the wave mode fields in the first resonator.

The power lost by the electrons to the wave mode fields in the second resonator 28 can be extracted by recovering the energy lost through diffraction around one or both of the mirrors of the second resonator 28 or by making one or both of the mirrors of the second resonator 28 partially transmitting at the wave mode frequency so that the energy passes through the mirrors. Alternatively, power may be extracted via a hole in the center of one of the mirrors of resonator 28. The extracted power can then be guided to a utilization device (not shown).

For further information on this quasi-optical gyroklystrom design, see U.S. Patent Application Ser. No. 414,129 filed on Sept. 2, 1982 by Manheimer, Bondeson, and Ott (Navy Case 66,517), now U.S. Pat. No. 4,491,765.

By way of example, for a quasi-optical gyroklyston design with the magnetic field B=48 KG, an electron beam voltage V=120 kV, an electron beam pitch angle of 1 radian, $L_y=12.5$, $R_M=3\ L_y$, a mirror size $\rho$ is chosen so that for the first harmonic the diffraction loss if $Y_1=0.215$, for the second harmonic the diffraction loss $Y_2=0.046$, and for the third harmonic the diffraction lose is $Y_3=0.01$. If the electron beam is a pencil beam localized at a field maxima, the gyroklyston will operate at the third harmonic for beam currents I between 2.4 A and 4.4 A; at the second harmonic for beam currents between 4.4 A and 7 A; and the fundamental for beam currents above 7 A.

To operate at high harmonics, it is found that higher beam voltages, high pitch angle, and lower currents are required as compared to fundamental and low harmonic operation. Additionally, for very high harmonic operation, the half lengths $L_y$ turn out to be quite large in order to avoid breakdown at the mirror while providing for high efficiency operation. However the larger $L_y/\lambda$ becomes, the more likely multimode operation becomes. It is known that there are three ranges for this quantity. For $L_y/\lambda<50$, the operation is almost certainly single moded. For $50<L_y/\lambda<2.5\times10^3$, multimode operation becomes increasingly likely but with precise phase relations between the nearby modes. In this range, single mode operation is much more likely in a double cavity klystron configuration than in a single cavity configuration. Finally, if $2.5\times10^3<L_y/\lambda 2.5\times10^3$, an essentially turbulent spectrum of radiation is produced. Thus, any design value should have $L_y/\lambda<2.5\times10^3$.

Design parameters are given below for eighth harmonic operation with a 250 kV, $\alpha=3$ beam. For instance, if $\omega r_o/c=45$ and $Y_8=10^{-3}$, then for beam currents between $0.54<I<0.8$ amps, the eighth harmonic should dominate the radiation. In all cases studied ($1.3\times10^{-2}$ cm$<\lambda<2.5\times10^{-1}$ cm) the cavity length can be chosen large enough to avoid breakdown at the mirrors, but small enough to avoid a turbulent radiation spectrum. Efficiencies are calculated to be several percent, implying radiated power of several kilowatts.

It should be noted that the design constraints set out in the present invention are only applied to the second resonator 28 in the two resonator gyroklystron configuration. This is because the second resonator 28 excites the first resonator 26 in terms of frequency and power.

The present gyrotron/gyroklyston configuration has a variety of advantages. The design of the quasi-optical cavities in conjunction with the appropriate choice of current in either the gyrotron or the gyroklystron configuration permit the accurate selection of a desired harmonic of the cyclotron frequency with the concurrent suppression of the lower order of harmonics and the cyclotron frequency fundamental.

Additionally, the present design permits very efficient operation. The calculated efficency for the present design is in the range of 20% or greater for the second and third harmonic operation with a pencil beam localized at a field maxima in the quasi-optical cavity. Likewise, for eighth harmonic operation, the efficiency is in the range of several percent with a pencil beam localized at a field maxima (in a single cavity configuration). This efficiency could be further enhanced by contouring the strength of the guide field and/or using a double cavity klystron configuration.

It should also be noted that with the present design very high frequency operation is possible with relatively low magnetic fields. For example, a 48 KG field and a 120 KV electron beam will produce radiation at the third harmonic, that is, a wave length on the order of 1 mm. This wavelength is roughly $2\frac{1}{2}$ times the nonrelativistic cyclotron frequency. As a further example, a 6.5 KG magnetic field produces radiation at the eighth harmonic, that is, a wavelength on the order of 2.5 mm. Alternatively, a 150 KG field produces radiation at a wavelength of 130 $\mu$m.

The present design has the feature of being able to provide high power on the order of tens of kilowatts. With this design short wavelength operation is possible with a large radiation volume. Moreover, the present device has a low electron beam voltage requirement. In this regard, efficient operation is possible with electron beam energies ranging from as low as a few keVs to several hundred keVs. Thus, wavelength of 100 μm can be produced with a 250 kV beam in a very compact system.

The present design is advantageous in that it utilizes the natural selection of the transverse mode in either the fundamental or higher harmonics. This natural selection is obtained via diffraction loses.

It should also be noted that the present device is relatively insensitive to electron beam quality. In this regard, a moderate thermal spread of electron beam pitch angle does not destroy the interaction of the beam with the radiation. Energy spreads of on the order of 1% or less can also be tolerated.

It should be noted that the gyroklystron configuration yields higher efficiency at lower current than a single cavity quasi-optical gyrotron and has more of a tendency for single mode operation. For this gyroklystron configuration, either active and/or passive longitudinal mode selection can be employed in the first cavity containing the lower power radiation. By way of example, a Fabre Perot or a diffraction grating may be utilized in the first cavity to select the frequency that is desired and to prevent other modes from growing therein. An additional feature for the gyroklystron is that a small magnetic field ripple in the drift region can be used to control the frequency bandwidth of the oscillator. In this regard, see *Infrared and Milimeter Waves,*, Vol. 9, Chapter 7, Academic Press,, Inc. 1983, pp. 318.

It should be noted that the present design, as set forth in FIG. 1 and FIG. 2, is for purposes of explanation only. There are a variety of alternative configurations that may be utilized. By way of example, although the most effective configuration for the electron beam propagation is transverse to the radiation axis, the direction of electron beam propagation may be at any angle (including coparallel) to the radiation axis.

It should also be noted that the external magnetic field can be adjustable in time and space to maximize conversion efficiency. For example, a slight taper may be added to the field. For further information in this regard, see the article by Levush, Bondeson, Manheimer, and Ott, entitled, "Theory of Quasi-Optical Gyrotrons and Gyroklystrons Operating at Higher Harmonics of the Cyclotron Frequency," International Journal of Electronics, 1983, Vol. 54, No. 6, pp. 749–775. The use of a tapered external magnetic field will permit increased control over the desired harmonic frequency. The external magnetic field can be supplied either by conventional or superconducting magnets.

It should also be noted that a distributed feedback circuit can be installed to effect longitudinal mode selection.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method for generating millimeter and submillimeter electromagnetic radiation at a desired harmonic $\omega_n$ of the cyclotron frequency in a quasi-optical gyrotron/gyroklystron configuration which includes a magnetic structure for producing a magnetic field parallel to an axial direction, an electron beam source for imparting momentum $p_z$ to electrons in the axial direction to define an electron beam traveling in the axial direction, and for imparting momentum $P_\perp$ to the electrons in the beam perpendicular to the axial direction to cause the electrons in the beam to execute gyratory motion, and at least one open resonator defined by at least two mirrors positioned downstream of the electron beam source for receiving therethrough the beam of electrons and for exchanging energy with the beam of electrons, the method comprising the steps of:

choosing a mirror radius size $\rho$ for the mirrors forming said at least one open resonator which is large enough relative to the spot size of a desired radiation cyclotron harmonic $\omega_n$ so that said harmonic $\omega_n$ oscillates within said at least one resonator, but small enough so that the spot size for the next lower cyclotron harmonic $\omega_m$ is larger than said mirror so that said harmonic $\omega_m$ does not oscillate due to diffraction losses;

generating an electron beam via said electron beam source with a beam current which is greater than or equal to the starting current $I_n$ for the nth cyclotron harmonic $\omega_n$, but less than the starting current $I_m$ for the mth cyclotron harmonic $\omega_m$; and extracting radiation energy at the nth cyclotron harmonic $\omega_n$ from said at least one open confocal resonator.

2. A method as defined in claim 1, wherein said mirror choosing step comprises the step of:

for a given cyclotron harmonic frequency $\omega_n$, a desired diffraction loss $Y_n$ for that harmonic n, a given half length separation $L_y$ between the mirrors defining said at least one resonator, and a given mirror radius of curvature $R_M$, determining a desired mirror radius size $\rho$ for the mirrors forming said at least one open resonator by the equation $$Y_n = \exp-(\rho/\gamma_{on})^2$$

where $\gamma_{on}$ is the spot size at the mirror for radiation at the nth cyclotron harmonic $\omega_n$.

3. A method as defined in claim 2 wherein the desired diffraction loss $Y_n$ for the harmonic number n is chosen within the range $0.001 \leqq Y_n < 0.05$ so that the diffraction loss $Y_m$ for the next lowest order harmonic is large enough to prevent oscillation thereof.

4. A method as defined in claim 2, wherein said determining step includes the step of determining $\gamma_{on}$ by the equation $$r_{on} = \left[ \frac{\lambda_o R_M}{n\pi} \cdot \frac{1}{((R_M/L_y) - 1))^{\frac{1}{2}}} \right]^{\frac{1}{2}}$$

where $\lambda_o$ is the wavelength of the fundamental cyclotron frequency and n is the harmonic number for the desired cyclotron harmonic $\omega_n$.

5. A method as defined by claim 4, wherein said electron beam generating step includes the step of calculating a starting beam current $I_i$ by determining the diffraction loss $Y_i$ for cyclotron harmonic $\omega_i$ by the equation $$Y_i = Y_n^{i/n}.$$

and using the equation:

$$I_i = \frac{E_o^2 r_o^2}{64} \cdot \frac{Y_i c}{\eta_i V}$$

where $\eta_i$ is the small signal efficiency for the cyclotron harmonic $\omega_i$ and $$n_i = \frac{\pi}{4} \frac{1}{(\gamma_o - 1)\gamma_o} \left[\frac{E_o}{B}\right]^2 \epsilon_o^2 \left[\frac{\Omega_o}{\omega_i}\right]^2 J_i'(\zeta_o) \exp\left[-\left(\epsilon_o \frac{\Delta\omega}{\omega_i}\right)^2 2\right] \cdot \left[\frac{\beta_{\perp o}^2 \Delta\omega}{2\omega_i} \epsilon_o^2 J_i'(\zeta_o) + \zeta_o J_i(\zeta_o)\left[1 - \frac{i^2}{\zeta_o^2}\right]\right],$$

where $\gamma_o$=electron energy divided by the rest energy $E_o$=electric field at the center of the optical cavity B=magnetic field in the cavity $\omega_i$=harmonic frequency whose efficiency is being calculated $\beta_{\perp o} = P_{\perp o}/m_e\gamma_o c$, $\beta_{zo} = P_{zo}/M_e\gamma_o c$ $P_{zo}$=momentum of the electron beam in the z direction $\epsilon_o = (\gamma_o \omega_n / c)/\beta_{zo}$ $\gamma_o$=spot size for the cyclotron harmonic whose efficiency is being calculated at the cavity center $\Omega_o = e\ B_o/mc$ $J_i$=Bessel function of order i $J'_i$=derivative of the Bessel function of order i $\zeta_o = k\ P_\perp/m_e\Omega_o$ $P_\perp$=transverse momentum of the electrons in the beam $k = \omega_i/c$ i=cyclotron harmonic number for the cyclotron harmonic whose efficiency is being calculated $\Delta\omega$=frequency displacement of the radiation resonating in said resonator from the cyclotron harmonic $\omega_i$ which maximizes $\eta_i$ for that harmonic.

6. A method as defined in claim 5, wherein the at least one open resonator includes a first and a second open spherical mirror resonators, each positioned downstream of the electron beam source, but at different locations, for receiving therethrough the beam of electrons, wherein the second resonator is positioned further downstream than said first resonator by a distance such that rapidly gyrating electrons in the beam overtake slowly gyrating electrons at the entrance to the second resonator with the right phase angle to lose power efficiently to wave mode fields in the second resonator, said method further comprising the step of feeding back a small amount of energy to the first resonator from the mode in the second resonator with a phase lag of approximately $\pi/2$ to generate those wave mode fields in the first resonator.

7. A quasioptical gyrotron/gyroklystron for generating millimeter and submillimeter radiation at a desired harmonic $\omega_n$ of the cyclotron frequency, comprising:

means for producing a magnetic field parallel to an axial direction;

a relativistic electron beam source for imparting momentum to electrons in the axial direction to define an electron beam traveling in the axial direction, and for imparting momentum to the electrons in the beam perpendicular to the axial direction to cause the electrons in the beam to execute a gyratory motion, said beam source generating an electron beam with a beam current which is greater than or equal to the starting current $I_n$ for the desired nth cyclotron harmonic, but less than the starting current $I_m$ for the mth cyclotron harmonic;

at least one open resonator defined by at least two mirrors positioned downstream of the electron beam source for receiving therethrough the beam of electrons and for exchanging energy between the beam of electrons and the wave mode fields set up in said resonator, wherein for a given cyclotron harmonic frequency $\omega_n$, a desired diffraction loss $Y_n$ for that harmonic n, a given half length separation $L_y$ between the mirrors, and a given mirror radius of curvature $R_M$, the mirror radius size $\rho$ for the mirrors forming said at least one resonator being determined by the equation $$Y_n = \exp -(\rho/r_{on})^2,$$

where $\gamma_{on}$ is the spot size at the mirror for radiation at the nth cyclotron harmonic and is calculated $$r_{on} = \left[\frac{\lambda_o R_M}{n\pi} \frac{1}{\left(\frac{R_M}{L_y} - 1\right)^{\frac{1}{2}}}\right]^{\frac{1}{2}},$$

where $\lambda_o$ is the wavelength of the fundamental cyclotron frequency and n is the harmonic number for the desired cyclotron harmonic $\omega_n$;

a collector electrode positioned downstream of the second resonator for collecting the electrons in the beam; and means for extracting radiation energy at the nth cyclotron harmonic from said second open confocal resonator.

8. A quasioptical gyroklystron for generating millimeter and submillimeter radiation at a desired harmonic $\omega_n$ of the cyclotron frequency, comprising:

means for producing a magnetic field parallel to an axial direction;

a relativistic electron beam source for imparting momentum to electrons in the axial direction to define an electron beam traveling in the axial direction, and for imparting momentum to the electrons in the beam perpendicular to the axial direction to cause the electrons in the beam to execute a gyratory motion, said beam source generating an electron beam with a beam current which is greater than or equal to the starting current $I_n$ for the nth cyclotron harmonic, but less than the starting current $I_m$ for the mth cyclotron harmonic;

a first open spherical mirror resonator defined by at least two opposing confocal mirrors positioned downstream of the electron beam source for receiving therethrough the beam of electrons and for exchanging energy with the beam to vary the speed of gyration of each electron in the beam according to the relative phase between its gyration and wave mode fields in the first resonator;

a second open spherical mirror resonator defined by at least two opposing confocal mirrors positioned downstream of the first resonator for receiving therethrough the beam of electrons, wherein for the given cyclotron harmonic frequency $\omega_n$, a desired diffraction loss $Y_n$ for that harmonic n, a given half length separation $L_y$ between the mirrors, and a mirror radius of curvature $R_M$, the mirror radius size $\rho$ for the mirrors forming said first and second open resonators is determined by the equation $$Y_n = \exp - (\rho / r_{on})^2,$$

where $r_{on}$ = is the spot size at the mirror for radiation at the nth cyclotron harmonic;

the second resonator being separated from the first resonator by a sufficient distance that rapidly gyrating electrons in the beam overtake slowly gyrating electrons at the entrance to the second resonator with the right phase angle to lose power efficiently to wave mode fields in the second resonator, energy feedback means coupled to the first and second resonators for feeding back a small amount of energy to the first resonator from the mode resonating in the second resonator with a phase lag of approximately $\pi/2$ to generate the wave mode fields in the first resonator;

the first and second resonators having a wave mode frequency slightly more than an integral multiple of the relativistic cyclotron frequency of the gyrating electrons in the beam;

a collector electrode positioned downstream of the second resonator for collecting the electrons in the beam; and means for extracting radiation energy at the nth cyclotron harmonic from said second open confocal resonator.

* * * * *